United States Patent [19]

Thomke et al.

[11] Patent Number: 4,610,550

[45] **Date of Patent: * Sep. 9, 1986**

[54] WATCH HAVING A CASE PROVIDING AN INTEGRAL BOTTOM-PLATE STRUCTURE

[75] Inventors: Ernst Thomke, Granges; Jacques Müller, Reconvilier, both of Switzerland

[73] Assignee: ETA S.A. Fabriques d'Ebauches, Granges, Switzerland

[ * ] Notice: The portion of the term of this patent subsequent to Apr. 8, 2003 has been disclaimed.

[21] Appl. No.: 628,055

[22] Filed: Jul. 5, 1984

[30] Foreign Application Priority Data

Jul. 8, 1983 [CH] Switzerland ..... 3755/83

[51] Int. Cl.[4] ..... G04B 37/00

[52] U.S. Cl. ..... 368/281; 368/296

[58] Field of Search ..... 368/281, 294, 295, 296

[56] References Cited

U.S. PATENT DOCUMENTS

| | | | |
|---|---|---|---|
| 4,218,873 | 8/1980 | Lang | 368/281 |
| 4,421,423 | 12/1983 | Lederrey | 368/281 |
| 4,487,513 | 12/1984 | Matsumoto | 368/276 |

FOREIGN PATENT DOCUMENTS 287616 7/1968 Switzerland .

*Primary Examiner*—Bernard Roskoski

*Attorney, Agent, or Firm*—Pollock, Vande Sande & Priddy

[57] ABSTRACT

A watch is described having a case made of an alloy or of a metal compound, e.g. stainless steel, which provides an integral bottom-plate structure. The case consists of a stack of plates. The two outermost plates form a back and a bezel, bearing the watch glass, respectively. The remaining plates are formed with openings that together define in the case housings for accommodating components of the watch.

20 Claims, 5 Drawing Figures

WATCH HAVING A CASE PROVIDING AN INTEGRAL BOTTOM-PLATE STRUCTURE

BACKGROUND OF THE INVENTION

1. Field of the Invention

This invention relates to a watch of the kind comprising a case, made of alloy or of a metal compound, which provides an integral bottom-plate structure.

2. Prior Art

One such watch is described in Swiss Patent Specification No. 577199. Its main advantages are that it is thinner and requires fewer parts, thereby decreasing its cost price. On the other hand, the case is more difficult to manufacture because of the need simultaneously to machine both a bottom-plate structure and a case. This not only adversely affects production costs but also restricts the scope for case design.

SUMMARY OF THE INVENTION

An object of the invention is to provide a watch of the kind set forth, which is simpler to manufacture and which offers greater scope for case design.

According to the invention there is provided a watch comprising a case, made of an alloy or of a metal compound, which is closed off by a glass and which provides an integral bottom-plate structure, and, within the case, a movement having a plurality of components individually mounted in the bottom-plate structure and display means, said case consisting of a stack of plates with the two outermost plates forming a back and a bezel, bearing said glass, respectively, and with the remaining plates being formed with openings that together define in the case housings for accommodating said components and at least part of said display means.

DETAILED DESCRIPTION

Figures 1A, 1B:
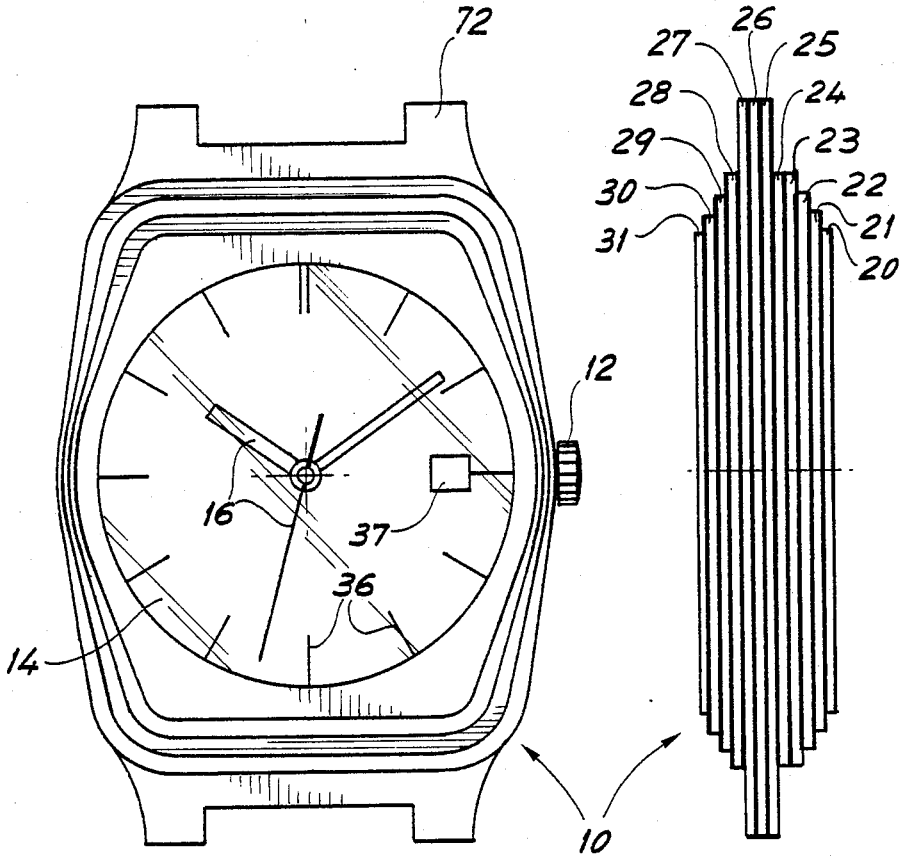
FIGS. 1*a* and 1*b* are respectively plan and side views of a watch according to the invention.

The watch shown in FIGS. 1*a* and 1*b* comprises a case 10, a control or actuating stem 12, a dial 14 and hands 16.

Figure 2:
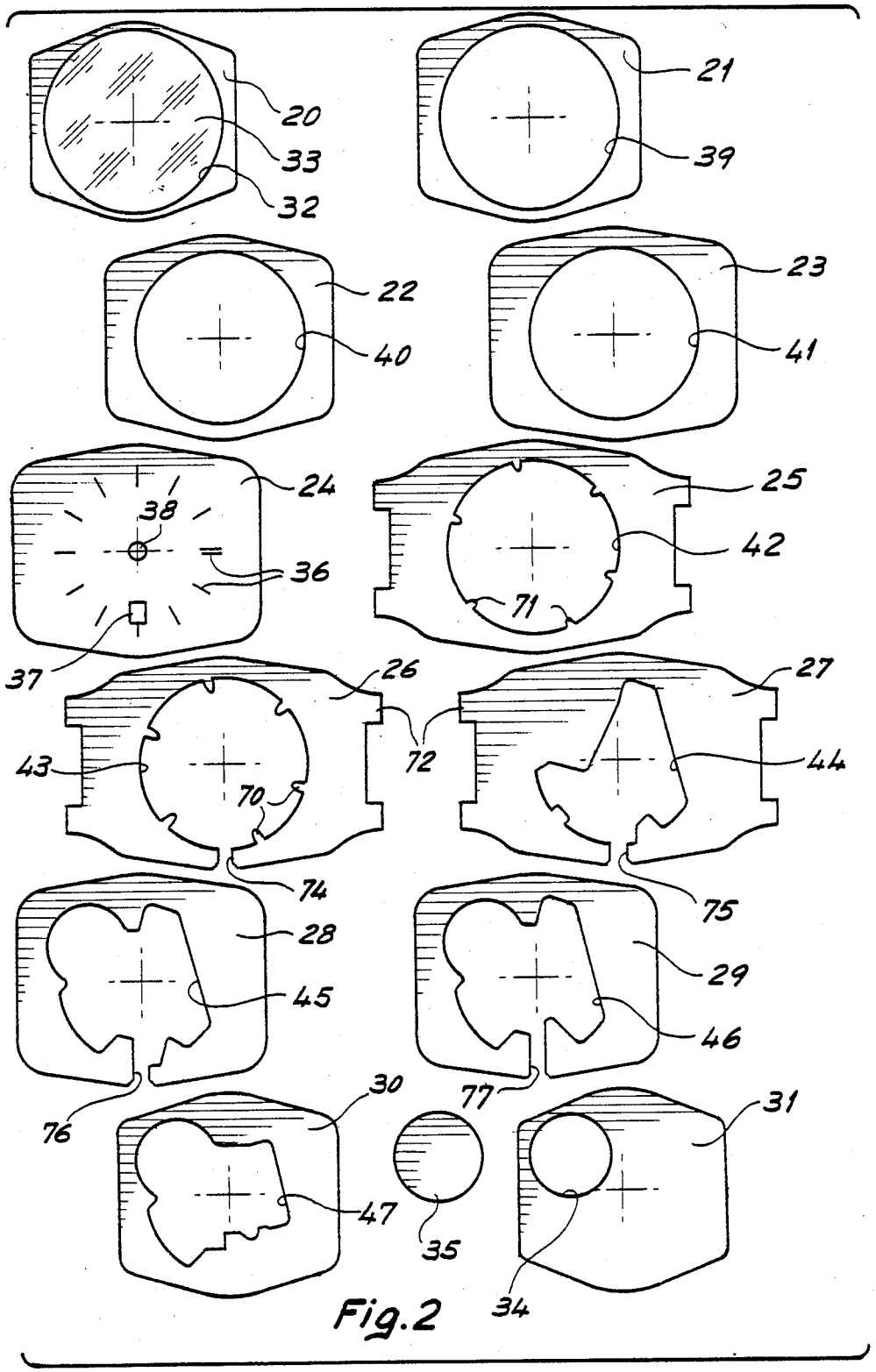
FIG. 2 is a plan view of plates used in making the case of the watch shown in FIGS. 1*a* and 1*b;*

The case 10 consists of a stack of twelve plates numbered 20 to 31, which are separately represented in FIG. 2. They each have a roughly hexagonal shape and are externally so sized as to form a middle of stepped outline, as apparent from FIGS. 1*a* and 1*b*.

The uppermost plate, 20, which forms the bezel, has a central opening 32 of circular shape which is closed off by a glass 33. The latter is preferably fixed in place with adhesive. Alternatively, plate 20 could itself be transparent and act as a glass. The lowermost plate, 31, which forms the back cover of the watch, is formed with a circular opening 34 for the insertion or removal of a battery. Opening 34 is closed by a circular hatch 35 which may, for example, be screwed into place.

Plate 24 acts as the dial and thus carries symbols 36 representing time divisions. It is provided with an aperture 37 through which a date-disc may be read, and with a small central hole 38 through which the spindles bearing the hands 16 may extend.

Plates 21, 22 and 23, which lie between bezel plate 20 and dial plate 24, are formed with circular openings 39, 40 and 41 respectively that together define in the assembled case a housing for the hands 16.

Plates 25,26,27,28,29 and 30, which lie between dial plate 24 and back plate 31, are formed with openings 42,43,44,45,46 and 47, respectively, having shapes such as to define in the case housings for components of the watch movement.

Figure 3:
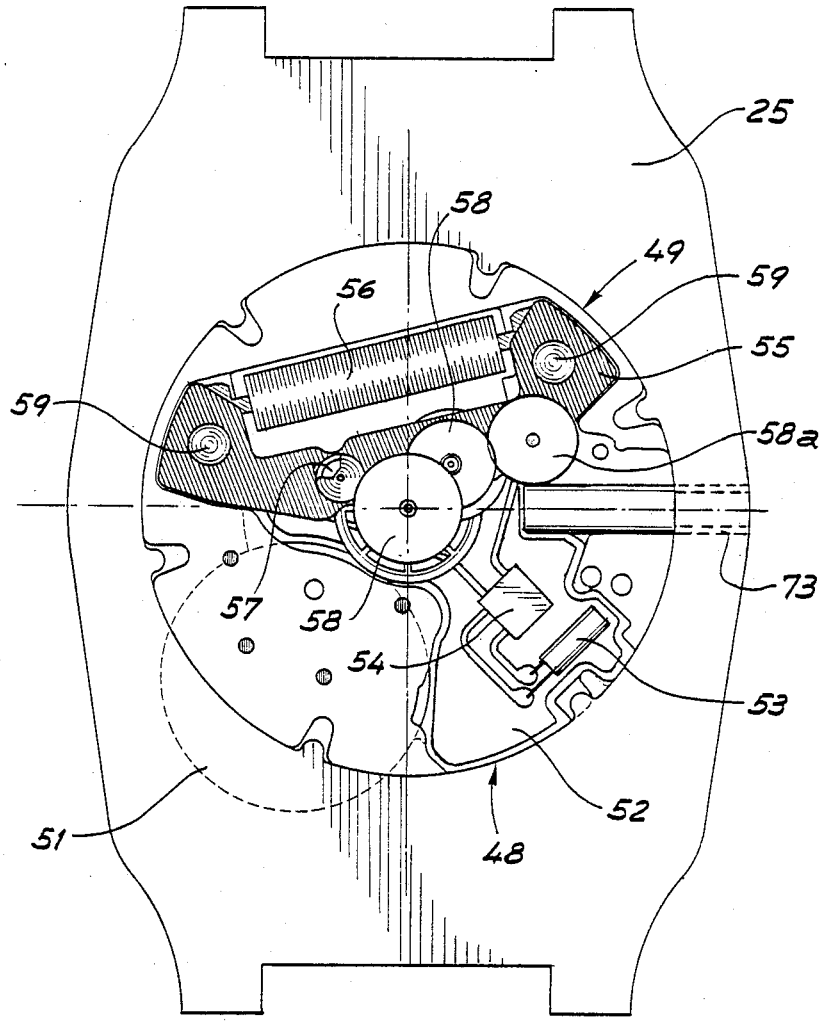
FIGS. 3 and 4 show the watch of FIG. 1 at two different intermediate assembly stages.
Figure 4:
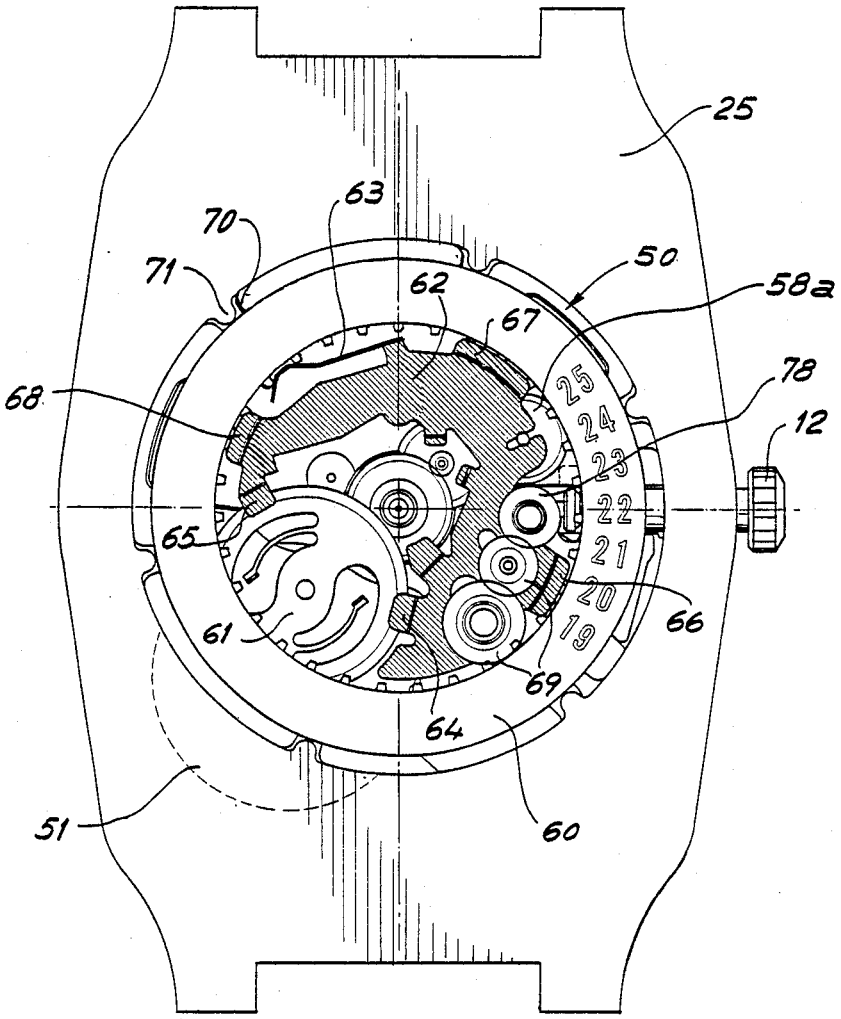

As shown in FIGS. 3 and 4, the movement essentially comprises an electronic module 48 (FIG. 3), a motor module 49 (FIG. 3), a data module 50 (FIG. 4) and a battery 51.

The electronic module 48 (FIG. 3) comprises a printed circuit 52, and, mounted on this circuit, a quartz resonator 53 and an integrated circuit 54. Module 48 is accommodated in opening 47 of plate 30 and rests on back-cover plate 31 to which it is secured with adhesive.

The motor module 49 (FIG. 3) comprises as its basic component a stator 55 on which are mounted a coil 56, a rotor 57 and a gear-train 58 for driving the hands 16. Gear-train 58 includes a setting wheel 58*a* actuatable by means of control stem 12. Module 49 is accommodated in openings 44,45,46 and 47 of plates 27,28,29 and 30 and rests on plate 30 to which it is secured by a pair of pins 59 soldered to plate 30.

The date module 50 (FIG. 4) comprises a date disc 60 and a wheel 61 for driving disc 60, wheel 61 being itself driven by the gear-train of module 49. A bridge 62 carries a jumper-spring 63 cooperating with the teeth of disc 60. A pair of fingers 64 and 65, borne by bridge 62, hold wheel 61 in position. Three other fingers, 66,67 and 68, also borne by bridge 62, hold disc 60 in place. Preferably, spring 63 and fingers 64 to 68 are integral with bridge 62. Bridge 62 also carries a correction gear train 69 which kinematically links control stem 12 and date disc 60.

Date module 50 is accommodated in the circular openings 42 and 43 of plates 25 and 26. Opening 43 is formed with fingers 70 (more clearly visible in FIG. 2), directed radially inwardly, on which disc 60 rests. Opening 42 is formed with fingers 71 that are shorter than fingers 70 and which serve to centre disc 60. Further, bridge 62 is soldered to plate 27 at three points which are not visible in the drawings.

Battery 51, which is inserted through opening 34 in back plate 31, is accommodated in openings 45,46 and 47 of plates 28,29 and 30.

Plates 25,26 and 27 are formed with lugs 72 for the attachment thereto of a wristlet (not shown).

Setting stem 12 is rotatably mounted in a tube 73 (FIG. 3) which is housed and secured with adhesive in openings 74,75,76 and 77 (FIG. 2) respectively provided in plates 26,27,28 and 29. Stem 12 drives a setting-wheel 78 (FIG. 4) mounted on a rocking lever (not visible in the drawings) pivotally mounted on plate 28. Depending on the position of this lever, such position being determined by the position of stem 12, setting-wheel 78 is free or meshes either with date correction gear-train 69 or with time setting wheel 58*a*.

The choice of materials used in making the plates is governed by their cost, their appearance, their mechanical strength and their resistance to chemical attack. Stainless steel, because of its moderate cost, its attractive appearance, its mechanical strength, its resistance to chemical attack and its machinability, is particularly suitable in the manufacture of the above described case. Copper or aluminium alloys offer a great diversity of colours because of the many kinds of surface treatment they can be subjected to. Particularly strong cases can be made by resorting to plates made of metal compounds such as the borides, nitrides and carbides of tantalum, titanium, tungsten, vanadium, etc., and oxides such as alumina.

Metal plates are preferably cut out of strips by means of a progressive swage which first cuts the inner openings before cutting the outer shape. Metal compound plates are produced by sintering, in moulds defining the inner and outer shapes. In both cases, the plates are subsequently subjected to finishing operations involving grinding, brushing and/or polishing. Because the plates are flat, these operations can be automated. The plates are finally subjected, if required, to a surface treatment that determines their final appearance, whereupon they are assembled.

To modify the outer shape of the case, it suffices to change one punch and one die in each of the progressive swages, or the outer part of the mould. The cost of these changes is low, the shapes being on the whole very straightforward.

The above-described watch may be assembled as follows. The lower plates 25 to 31 are first assembled with adhesive to form an integral bottom-plate structure. During this operation, tube 73 is also secured in its housing with adhesive. Electronic module 48, motor module 49, control stem 12, the rocking lever carrying setting-wheel 78 and finally date module 50 are then mounted in the resulting bottom-plate structure. Dial plate 24 is then secured with adhesive on plate 25, whereupon hands 16 are put in place. The watch is then closed by stacking plates 20 to 23 on plate 24. These plates are also secured with adhesive. Battery 51 is then put into its housing through opening 34 which is then closed by hatch 35.

The plates could of course also be assembled by means that will enable the watch to be taken apart, such as screws and internally threaded studs.

While the above embodiment is that of a watch in which the time is displayed by hands, the invention is also applicable to watches in which the time is displayed by electro-optical means.

It will be apparent that the invention enables the manufacturing costs of watches, having a metal or metal compound case, to be lowered while still providing scope for case design.

We claim:

1. A watch case for housing a display means for displaying time and a movement means for providing said time, said case providing an exterior outline for a watch and comprising:

a bezel plate having at least a portion made of a transparent material for viewing said display means and an outer edge portion providing part of said exterior outline;

at least one display plate having an opening for housing at least part of said display means and an outer edge portion providing part of said exterior outline;

at least one movement plate having an opening for housing at least part of said movement means and an outer edge portion providing part of said exterior outline;

a back plate having an outer edge portion providing part of said exterior outline; and, means for securing said plates together in a stack so as to provide a case structure;

said bezel plate and said back plate being the outermost plates of said stack and arranged to close off the front side and the back side, respectively, of said case structure;

said at least one display plate and said at least one movement plate being substantially flat and stacked one on top of another; and, said at least one movement plate and said back plate being integrally secured together by said securing means so as to provide an integral bottom-plate structure for mounting at least part of said movement means.

2. The watch case of claim 1 which comprises at least two of said movement plates and said at least two movement plates and said back plate are substantially flat and are integrally secured together by said securing means so as to provide an integral bottom-plate structure.

3. The watch case of claim 1 in which said integral bottom-plate structure includes means for individually mounting a plurality of movement means components.

4. The watch case of claim 1 which comprises at least three of said display plates and at least three of said movement plates.

5. The watch case of claim 1 in which said display means includes a dial and hands, and in which said dial comprises one of the plates of said stack.

6. The watch case of claim 1 in which at least one of the plates of said stack has wristlet securing lugs.

7. The watch case of claim 1 in which the plates of said stack are made of stainless steel.

8. The watch case of claim 1 in which the plates of said stack are made of a boride, nitride or carbide of vanadium, tungsten, titanium or tantalum.

9. The watch case of claim 1 in which said securing means comprises an adhesive.

10. The watch case of claim 1 which comprises at least two of said display plates and at least two of said movement plates.

11. The watch case of claim 1 in which said bezel plate comprises a central glass portion supported by an outer rim portion of a metallic material.

12. The watch case of claim 1 in which all of said plates are substantially flat and are stacked one on top of another.

13. The watch case of claim 1 in which said at least one display plate and said at least one movement plate each have a swaged opening and a swaged outer edge portion.

14. The watch case of claim 1 in which said case comprises a plurality of substantially flat movement plates stacked one on top of another.

15. The watch case of claim 1 in which said case comprises at least three substantially flat movement plates stacked one on top of another.

16. A watch case for housing a display means for displaying time and a movement means having a plurality of components for providing said time, said case providing an exterior outline for a watch and comprising:

a bezel plate having at least a portion made of a transparent material for viewing said display means and an outer edge portion providing part of said exterior outline;

at least one display plate having an opening for housing at least part of said display means and an outer edge portion providing part of said exterior outline;

at least one movement plate having an opening for housing at least part of said movement means and an outer edge portion providing part of said exterior outline;

a back plate having an outer edge portion providing part of said exterior outline; and, means for securing said plates together in a stack so as to provide a case structure;

said bezel plate and said back plate being the outermost plates of said stack and arranged to close off the front side and the back side, respectively, of said case structure; and, said at least one movement plate and said back plate being integrally secured together by said securing means so as to provide an integral bottom-plate structure for individually mounting at least two of said movement means components.

17. The watch case of claim 16 which comprises a plurality of said movement plates, and in which at least two of said plurality of movement plates and said back plate are secured together by said securing means so as to provide an integral bottom-plate structure.

18. The watch case of claim 16 in which at least one of said movement means components rests on said back plate and another of said movement means components rests on said at least one movement plate.

19. A watch case for housing a display means having a dial and hands for displaying time and a movement means for providing said time, said case providing an exterior outline for a watch and comprising:

a bezel plate having at least a portion made of a transparent material for viewing said display means and an outer edge portion providing part of said exterior outline;

at least one display plate having an opening for housing at least part of said display means and an outer edge portion providing part of said exterior outline;

a dial plate providing said dial;

at least one movement plate having an opening for housing at least part of said movement means and an outer edge portion providing part of said exterior outline;

a back plate having an outer edge portion providing part of said exterior outline; and, means for securing said plates together in a stack so as to provide a case structure;

said bezel plate and said back plate being the outermost plates of said stack and arranged to close off the front side and the back side, respectively, of said case structure; and, said at least one movement plate and said back plate being integrally secured together by said securing means so as to provide an integral bottom-plate structure for mounting at least part of said movement means.

20. The watch case of claim 19 in which said dial plate has an outer edge portion providing part of said exterior outline.

* * * * *